United States Patent [19]

Knight et al.

[11] Patent Number: 4,533,091

[45] Date of Patent: Aug. 6, 1985

[54] PORTABLE MULTIPLE SPOOL WIRE DISPENSER

[76] Inventors: Reed H. Knight, 2011 Todd Way; Val L. Longmore, 4374 Alice Way, both of Salt Lake City, Utah 84199

[21] Appl. No.: 608,701

[22] Filed: May 10, 1984

[51] Int. Cl.[3] ..... B65H 49/00

[52] U.S. Cl. ..... 242/129.6; 242/55.3; 248/210

[58] Field of Search ..... 242/129.5, 129.6, 129.62, 242/129.8, 55.3, 139; 211/99, 100, 104; 248/210–211, 216.1, 216.4, 217.1, 217.3, 218.4; 182/121, 122

[56] References Cited

U.S. PATENT DOCUMENTS

| | | | |
|---|---|---|---|
| 876,089 | 1/1908 | Phillips | 242/55.3 |
| 2,957,644 | 10/1960 | Beardslee | 242/139 |
| 3,837,597 | 9/1974 | Bourhenne | 242/129 |
| 4,303,145 | 12/1981 | Vasquez | 82/122 |

FOREIGN PATENT DOCUMENTS

| | | | |
|---|---|---|---|
| 667998 | 5/1937 | Fed. Rep. of Germany | 248/211 |

*Primary Examiner*—Leonard D. Christian
*Attorney, Agent, or Firm*—Robert R. Finch

[57] ABSTRACT

A wire dispensing device having two brackets adapted to mount on spaced apart step ladder support legs and a spool holding shaft spanning the distance between brackets and secured thereto. The shaft is so mounted to the brackets that one end can be swung out for adding or removing spools.

3 Claims, 4 Drawing Figures

PORTABLE MULTIPLE SPOOL WIRE DISPENSER

FIELD BACKGROUND AND SUMMARY OF THE INVENTION

This invention relates generally to construction aids for use by electricians and particularly to a portable device enabling an electrician to have readily at hand one or more spools of color coded wires from which wires may be taken as needed.

In wiring, it is common to thread coded wires through conduit to install desired circuits. In such cases the various colored wire is supplied in individual spools which must be taken to the immediate work area where wire is pulled from one or more spools as needed and threaded through the conduit. The electrician usually works from a step-ladder and is required to get on and off the ladder to manipulate the wires. Also, when the ladder is moved, the spools, which must also be moved, get in the way and or the wires get tangled.

Efforts have been made to overcome the foregoing problem, but so far no device has proven satisfactory for the types of wires and work under consideration. U.S. Pat. No. 3,837,597 describes a device that clamps on a fixed stud and presents a horizontal table with a vertical shaft about which a coil of wire may be placed. The coil is supported on the table and rotates therewith as wire is unwound. The device cannot be used with a plurality of spools because they would interfere with each other. Also, the device is designed for use with vertical standing studs and is only useful if they are available.

It is the primary object of this invention to provide a wire dispensing device for dispensing coiled wire from one or more spools of wire at an electrician's work station.

Another object is the provision of a device for mounting a plurality of wire reels which device is portable and is specifically adapted to be attached to the generally upright but not necessarily vertical support rails of an electrician's ladder to have the spools readily available for use even though the ladder is moved from place to place.

A related object is the provision of a coiled wire dispenser of the type described which is adapted to be mounted on ladders of different widths.

The foregoing and probably other objects are achieved by a structure that comprises a pair of brackets each adapted to fit on the generally upright spaced-apart legs of a ladder, means on each bracket for clamping it in place on the legs, a horizontal shaft extending between the spaced apart brackets, means detachably securing the shaft to the brackets whereby, when the assembly is in place on a ladder, at least one end of the shaft may be detached from its respective bracket to enable threading of spools thereon or removal therefrom. The other end of the shaft may be fixed by a pivot to allow the shaft to be swung for such access. It is important that the shaft be generally horizontal and that the several spools be free to rotate independently to insure maximum flexibility of use.

In order that the invention may be more readily understood and carried into effect, reference is made to the accompanying drawings and description thereof which are offered by way of example only and not in limitation of the invention the scope of which is defined by the appended claims.

DETAILED DESCRIPTION OF INVENTION AND THE DRAWINGS

Figure 1:
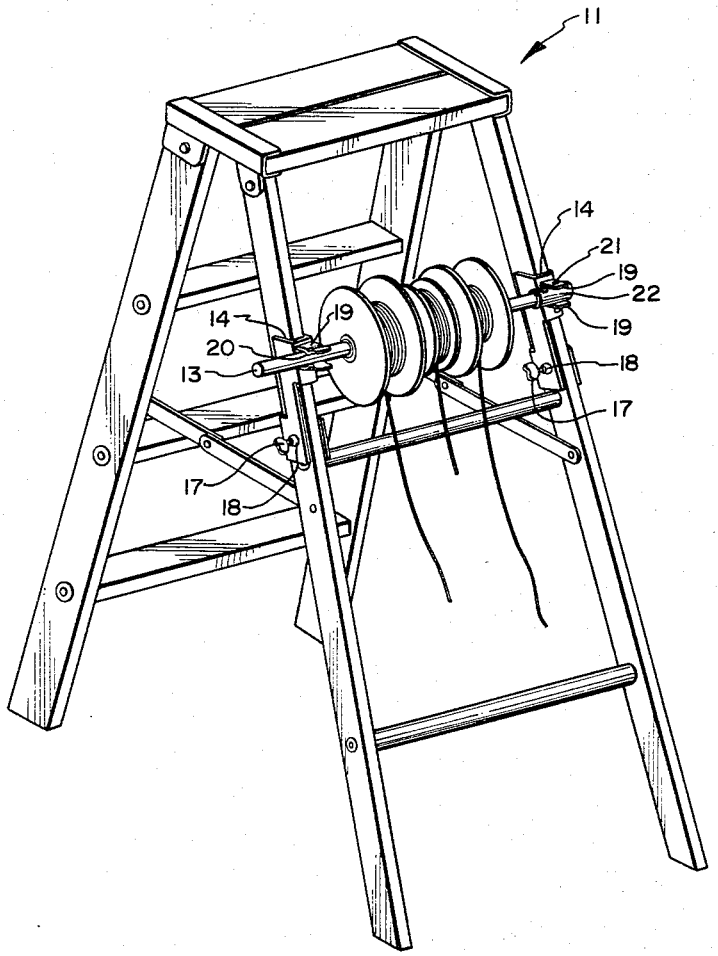
FIG. 1 is a perspective view of the device installed on a ladder.
Figure 2:
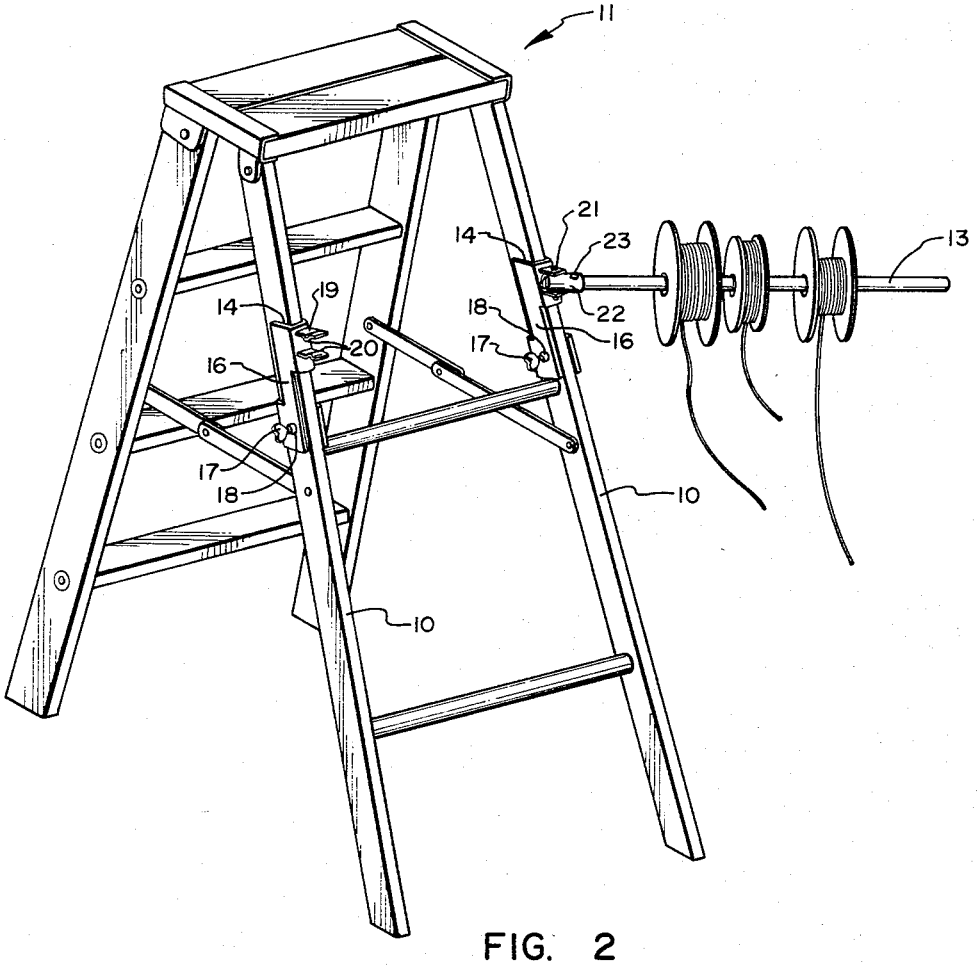
FIG. 2 is a view similar to FIG. 1, but with the shaft swung free for adding or removing spools.
Figure 3:
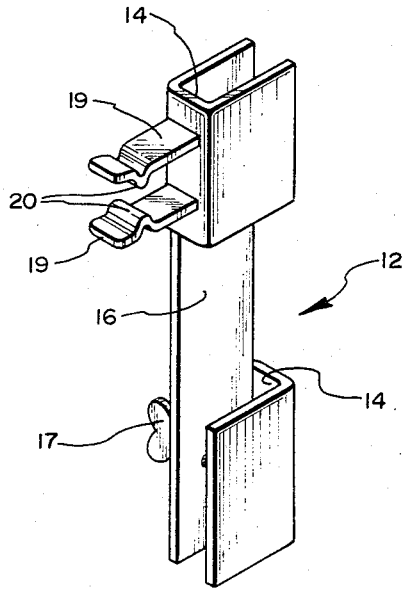
FIG. 3 is a perspective view of one of the brackets of the invention.
Figure 4:
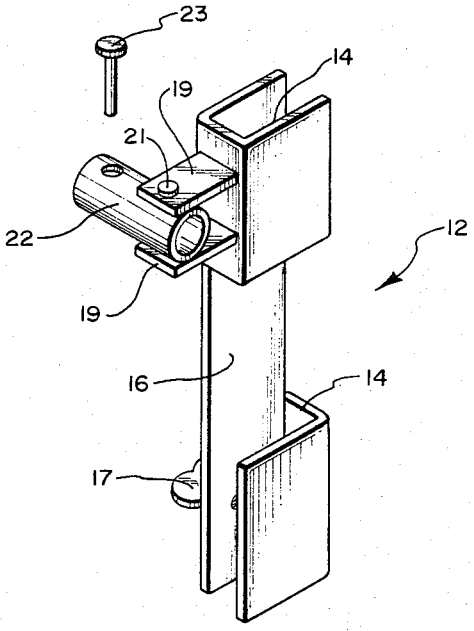
FIG. 4 is a perspective view of another one of the brackets.

As illustrated in FIG. 1 the device is installed on the generally upright spaced apart support legs 10 of a ladder 11. The device itself comprises a pair of brackets 12 and a horizontal tubular shaft 13 spanning the space between the brackets. Each bracket is formed with a pair of spaced apart U shaped members 14 connected together by a plate or arm 16 that is actually an elongated plate which forms one wall of both U members. The U members are oriented so that when rotated in a plane they both face in the direction of rotation. As illustrated, the bracket is fitted on the legs and rotated into place. To secure the bracket, a set screw 17 extends through a threaded base 18. Extending from the base of one of the primary U members 14 of each bracket is a secondary U member 19 that is transverse and oppositely facing to the primary U member. A shaft spans the space between brackets. A short cylindrical collar 22 is received in the U and is secured therein by a pin 21 about which it pivots. The collar and shaft are sized so the shaft 13 can be received in the collar. Although not quite as convenient, the collar can be omitted and the shaft 13 pivoted directly on the pin 21. In either event, the shaft pivots about the pin 21. In the other bracket, the free end of the shaft is received in the secondary U and is simply restrained therein by a clip 20 formed thereon. This way, one end of the shaft can move relative to the bracket thus enabling the assembly to accommodate ladders or various widths. In this connection, the shaft must be of sufficient length to span the distance between the brackets when the brackets are in place on the support legs. It is not necessary that the two support legs be parallel. What is important is that the brackets be so positioned relative to each other that the shaft can be secured in place on both brackets and be approximately horizontal so that the shaft and reels will stay in place during use.

When in use the dispenser will hold several spools of wire from one or more of which the electrician can take wires. If the dispenser is mounted on a ladder, it can simply be moved with the ladder from station to station.

For storage the dispenser is simply disassembled in which form it takes very little space.

We claim:

1. A plural spool wire dispensing device for mounting on the spaced apart generally upright support legs of a free standing ladder said device comprising first and second brackets each bracket having a pair of oppositely facing primary channels secured in spaced relationship by an arm, said primary channels being adapted to fit over one of said support legs on a free standing ladder, clamp means on each bracket for securing it in selected position on a support leg on which it is mounted, an elongated shaft of length to at least span the distance between said brackets when the same are on said support legs, and means on each bracket for receiving and supporting opposite end portions of said shaft said last named means comprising on each bracket a secondary channel extending outwardly from and transverse to one of said primary channels.

2. A wire dispensing device according to preceding claim 1 with the addition of means in said outwardly facing secondary channel on a first one of said brackets pivotally mounting one end of said shaft to said channel and means on said outwardly facing secondary channel of the other one of said brackets for detachably securing therein the opposite end portion of said shaft.

3. A wire dispensing device according to preceding claim 2 in which said means pivotally mounting said one end of said shaft in said secondary channel includes a relatively short cylindrical collar member pivotally mounted in said secondary channel and said one end of said shaft is received in said collar.

* * * * *